US009735472B2

(12) United States Patent
Bernhard et al.

(10) Patent No.: US 9,735,472 B2
(45) Date of Patent: Aug. 15, 2017

(54) ELASTICALLY DEFORMABLE ITEM OF SPORTS EQUIPMENT COMPRISING A DEFORMABLE ELECTROMAGNETIC COIL STRUCTURE

(71) Applicant: Fraunhofer-Gesellschaft zur Foerderung der angewandten Forschung e.V., Munich (DE)

(72) Inventors: Josef Bernhard, Nabburg (DE); Markus Hartmann, Sulzbach-Rosenberg (DE); Joern Eskildsen, Torring (DK); Ingmar Bretz, Regenstauf (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 80 days.

(21) Appl. No.: 14/415,659

(22) PCT Filed: Nov. 27, 2012

(86) PCT No.: PCT/EP2012/073731
§ 371 (c)(1),
(2) Date: Jan. 19, 2015

(87) PCT Pub. No.: WO2014/015917
PCT Pub. Date: Jan. 30, 2014

(65) Prior Publication Data
US 2015/0180127 A1 Jun. 25, 2015

Related U.S. Application Data

(60) Provisional application No. 61/675,984, filed on Jul. 26, 2012.

(51) Int. Cl.
*H01Q 1/00* (2006.01)
*H01Q 7/02* (2006.01)
(Continued)

(52) U.S. Cl.
CPC ..... *H01Q 7/02* (2013.01); *A63B 41/00* (2013.01); *A63B 43/004* (2013.01); *A63B 45/00* (2013.01);
(Continued)

(58) Field of Classification Search
USPC ..... 343/720, 702
See application file for complete search history.

(56) References Cited

U.S. PATENT DOCUMENTS 3,774,194 A 11/1973 Jokay et al.
4,299,384 A 11/1981 Van Auken
(Continued)

FOREIGN PATENT DOCUMENTS

CN 1602257 A 3/2005
CN 101678228 A 3/2010
(Continued)

*Primary Examiner* — Hoang Nguyen
*Assistant Examiner* — Hai Tran
(74) *Attorney, Agent, or Firm* — Murphy, Bilak & Homiller, PLLC

(57) ABSTRACT

Embodiments relate to an elastically deformable item of sports equipment (100; 200; 250; 300; 500), comprising at least one deformable electromagnetic coil structure (104; 204; 254; 304; 504) arranged around a curved surface (102; 106; 202; 206; 252; 256; 302; 306; 502; 506) within the item of sports equipment, wherein the at least one deformable electromagnetic coil structure has an elongation reserve corresponding to a maximum elastic deformation of the item of sports equipment.

17 Claims, 8 Drawing Sheets

(51) Int. Cl.

| | |
|---|---|
| ***A63B 69/00*** | (2006.01) |
| ***A63B 71/06*** | (2006.01) |
| ***A63B 41/00*** | (2006.01) |
| ***A63B 43/00*** | (2006.01) |
| ***A63B 45/00*** | (2006.01) |
| ***H01Q 1/22*** | (2006.01) |
| ***H01Q 7/00*** | (2006.01) |

(52) U.S. Cl.
CPC ..... *A63B 69/002* (2013.01); *A63B 69/0026* (2013.01); *A63B 71/0605* (2013.01); *H01Q 1/22* (2013.01); *H01Q 7/005* (2013.01); *Y10T 29/49016* (2015.01)

(56) References Cited

U.S. PATENT DOCUMENTS

| | | | | |
|---|---|---|---|---|
| 4,754,285 | A * | 6/1988 | Robitaille ..... | H01Q 1/44 343/718 |
| 2005/0070375 | A1 | 3/2005 | Savarese et al. | |
| 2005/0288134 | A1 | 12/2005 | Smith | |
| 2009/0248105 | A1 | 10/2009 | Keilman et al. | |
| 2010/0184563 | A1 * | 7/2010 | Molyneux ..... | A43B 1/0054 482/1 |

FOREIGN PATENT DOCUMENTS

| | | | |
|---|---|---|---|
| DE | 4327433 | A1 | 2/1995 |
| EP | 2189193 | A1 | 5/2010 |
| GB | 1370331 | A | 10/1974 |
| JP | 037852 | U | 1/1991 |
| JP | 07198836 | A | 8/1995 |
| JP | 0857085 | A | 3/1996 |
| JP | 2007506972 | A | 3/2007 |
| WO | 2012095610 | A1 | 7/2012 |

* cited by examiner

ELASTICALLY DEFORMABLE ITEM OF SPORTS EQUIPMENT COMPRISING A DEFORMABLE ELECTROMAGNETIC COIL STRUCTURE

Embodiments of the present invention generally relate to elastically deformable items of sports equipment, such as inflatable balls, for example, and more particularly to elastically deformable items of sports equipment comprising at least one deformable electromagnetic coil structure arranged around a curved surface within the item of sports equipment.

BACKGROUND

An electromagnetic coil, or simply a coil, is formed when an electrical conductor, such as e.g. a copper wire, is wound to create an inductive or electromagnetic element. Thereby the wire may also be wound around a core or form. One loop of wire may be referred to as a turn, and a coil comprises one or more turns. Coils serving as inductors are wide-spread in electronic circuits as a passive two-terminal electrical component that stores energy in its magnetic field. For example, coils may be used for realizing transformers for transferring energy from one electrical circuit to another by inductive coupling without moving parts. Also, coils may be used to build resonant circuits comprising serial and/or parallel arrangements of inductors and capacitors. In some applications coils may also serve as antennas or antenna-like elements for detecting electromagnetic fields, such as e.g. in Radio Frequency Identification (RFID) or similar applications.

In one of such applications, for example, it is proposed to detect a transition of a moving playing object, such as a ball or a puck, through a detection plane (e.g. a goal plane) using electromagnetic fields and/or signals. In some ball sports, as e.g. soccer or football, the usage of automated goal-detection systems is discussed in order to avoid human wrong decisions. Thereby the so-called goal-line technology is a technology, which can determine when the ball has crossed the goal line, assisting the referee in calling a goal or not. There are various alternative approaches for determining the exact position or location of the ball, such as video-based or electromagnetic field based systems. In an electromagnetic field based system a moving object, such as a ball, may be equipped with electronic circuitry for transmitting and/or receiving and/or reflecting electromagnetic signals. For such electromagnetic approaches electronic components are required inside the ball, wherein the size of the electronics may differ depending on its functionality and the used frequency range. For small and medium-sized systems the electronic may be installed within the ball's center, for example. For goal-detection systems requiring more area and volume, as e.g. for systems using magnetic fields in the sub-MHz range, the required loop antennas and/or the further electronic components may be installed on the circumference of the ball.

For achieving detection properties which are possibly rotationally invariant, one goal-detection system proposes to install three orthogonally placed coils or loop-antennas within or on a moving object, e.g., a ball, for emitting or reflecting at least a portion of an electromagnetic field. Due to this orthogonal arrangement of the coils the rotational position of the ball only has little influence on the electromagnetic emission or reflection properties, as in theory the three orthogonal loop-antennas always amount to an effective loop-antenna, whose effective opening surface is perpendicular to an incident magnetic field coming from a transmitter installed at or near the goal. That is to say, the normal of the effective opening surface is essentially parallel to the magnetic field vector.

For a correct functioning, i.e. high precision, of goal-detection systems electromagnetic properties of the ball or a puck are a crucial criterion. In one exemplary goal-detection system 800 (see FIG. 8*a*) a magnetic field $\vec{H}$ may be generated by means of a current-carrying conductor embracing a goal frame 802. The generated magnetic field $\vec{H}$ is thereby perpendicular to a detection plane 804 defined by the goal frame 802. This stimulating magnetic field $\vec{H}$ is reflected by the ball 806, wherein the reflected signal $\vec{H}_B$ should generate the same directional vector as the stimulating field $\vec{H}$ (due to the ball electronics with a shifted phase). The geometric accuracy of the reflected signal directly influences the measurement result and, hence, the accuracy of the goal decision.

The detection system 800 is based on three orthogonal coils 808-1, 808-2, and 808-3 in the ball 806 (see FIG. 8*b*). Each of the coils 808-1, 808-2, and 808-3 may comprise a plurality of turns which may, for example, be inserted in between the ball bladder and the ball hull or cover. For avoiding any irregularities in the ball hull the inserted coils 808-1, 808-2, and 808-3 should be rather flat between the ball bladder and the ball hull (i.e. the ball cover). Hence, the windings or turns of the coil should be arranged possibly side-by-side along the circumference of the ball 806.

The fabrication of items of sports equipment or playing equipment, such as balls, being equipped with more or one coils or loop-antennas, in particular arranged on its circumference, is relatively cumbersome. Furthermore, the exact positioning of the coils within or around the ball is crucial. It is desirable to provide a concept of how the at least one coil or loop antenna may be designed and how it may be integrated into the item of sports equipment in order to withstand mechanical and/or elastic deformations of the deformable item of sports equipment, for example, when hit from a player or shot against an obstacle, such as a goal frame, for example.

SUMMARY

For best system performance of an electromagnetic field based goal detection system preferably three essentially mutually orthogonal loop antennas or electromagnetic coils may be integrated into an item of sports equipment, which may be an air inflatable ball, according to some embodiments, such as a soccer ball. Normally such an air inflatable ball, like a football or a handball, comprises at least an outer ball cover, i.e., a ball hull, and an inner ball bladder underneath the ball cover. It is also possible to add additional material between the cover and bladder to protect the bladder from outside impacts, as, for example, stitches or the like. Although embodiments of the present invention are also applicable to playing equipment other than balls, the principles of the present invention will be predominantly explained with respect to air inflatable balls.

A reflected electromagnetic signal from the integrated loop antennas or coils in a ball depends on the circumference or diameter of the at least one loop antenna in the ball. That is to say, the higher the loop diameter the higher will be the signal strength of a reflected signal and the better will be a detection rate of an electromagnetic field based goal detection system. As a consequence, in order to obtain a possibly high loop antenna diameter, the one or more loop antennas in the ball should be fitted to an outer shape of the ball. This may be done by placing a loop antenna in form of an electromagnetic coil directly under the ball cover, between the ball cover and bladder or an additional protection tissue, or inside the ball bladder next to the inner wall of the bladder. However, when doing this, an elastic deformation of the ball comprising cover and bladder may be directly transferred to the integrated electromagnetic coils. Without any countermeasures the coils may be damaged in case of elastic ball deformations.

Hence, embodiments of the present invention aim to provide coils which can withstand or adapt to elastic deformations of a ball, and items of sports equipment in general. For that purpose the at least one electromagnetic coil structure integrated into the elastically deformable item of sports equipment may be designed such that the electromagnetic coil structure has an elongation reserve (expansion buffer) corresponding to a maximum elastic deformation of the item of sports equipment.

Accordingly, according to a first aspect of the present invention it is provided an elastically deformable item of sports equipment, in particular an air inflatable ball, comprising at least one deformable electromagnetic coil structure arranged around a curved surface within the item of sports equipment, wherein the at least one deformable electromagnetic coil structure has an elongation or expansion reserve corresponding to a maximum elastic deformation or a resulting expansion of the item of sports equipment. An elastic deformation of the item of sports equipment or playing equipment may result from a player hitting the playing equipment or the playing equipment itself hitting an obstacle, such as a goal frame, for example.

As mentioned before, embodiments are not strictly restricted to balls. Generally, an item of sports equipment may be understood as any movable playing object or equipment. Therefore also an ice hockey puck may be understood as an item of sports equipment in the context of this specification, for example. That is to say, the item of sports equipment may belong to the group of a soccer ball, an American football ball, a Rugby ball, a basketball, a handball, a volleyball, a tennis ball, a golf ball, a billiard ball, a bowling ball, or a puck. Note that this exemplary list is not to be understood as being conclusive. Principles of the present invention may also be transferred to other items of sports equipment or playing equipment.

The at least one electromagnetic coil structure may comprise at least one turn of an electromagnetic coil or loop antenna. Typically, the electromagnetic coil structure will comprise more than one turns of a coil. In a preferred embodiment the electromagnetic coil structure comprises at least three electromagnetic coils arranged mutually perpendicular or orthogonal to each other within the item of sports equipment, e.g. ball. In particular, in some embodiments, the three electromagnetic coils may be arranged on a common flexible and flat Printed Circuit Board (PCB) on a spherical surface within the item of sports equipment, e.g., in between a ball bladder and a ball hull or cover of the ball.

Hence, a flexible and preferably elastic coil or loop antenna integrated with the sports equipment may be based on flexible electronics, also referred to as flex circuits. This is a proven technology for assembling electronic circuits by mounting electronic devices on flexible plastic substrates, such as polyimide, PolyEther Ether Ketone (PEEK), thermoplastic polyurethane (TPU), or polyester. Such flexible plastic substrates may also be elastic allowing for elastic expansion and contraction of the flexible coil. Flexible electronic assemblies may be manufactured using the same components used for rigid Printed Circuit Boards (PCBs), allowing a flexible PCB to conform to a desired shape, or to flex during its use. According to embodiments the desired shape of the flexible PCB is that of a coil or a loop-antenna. Flexible printed circuits (FPC) can be made with standardized and exact photolithographic technology, for example. According to embodiments conductive pathways, tracks or signal traces, e.g. etched from at least one copper sheet (conductive layer) laminated onto a non-conductive flexible non-conductive substrate (e.g. polyimide, PEEK, TPU, polyester, etc.), may function as one or more turns of a flexible coil. Also, electronic circuits on a flexible PCB may be constructed by standardized Surface-Mount Technology (SMT), which is a method electrical components are mounted directly onto the surface of PCBs.

The curved surface within the item of sports equipment may, in an undeformed or non-deformed condition of the item, be a spherical surface having a circumference, wherein a length of at least one turn of the coil structure may be larger than said circumference in some embodiments to allow for said elongation reserve. For example the curved surface may be the inner or outer surface of a ball bladder or the inner or outer surface of a ball cover. That is to say, some embodiments of the present invention suggest integrating electromagnetic coils into the item of sports equipment, which preferably have a higher circumference than the item of sports equipment itself. This can be realized in various ways.

As the coils typically consist of electrically conductive material like copper, silver or aluminium, the elasticity of the coil itself is quite lower than the elasticity of a ball cover, a ball bladder, or a protection tissue. On the other hand, the stiffness of the coils acts against the deformation of the ball and the dynamic behavior of the ball can heavily be influenced. For that purpose some embodiments suggest meandering or zigzag patterns of windings of the at least one coil structure. That is to say, the length of the at least one turn of the coil structure being larger than the circumference of the spherical surface may be realized by meandering the electrical conductor of the coil lateral to a circumferential direction. That is to say, an electric conductor of the at least one deformable electromagnetic coil structure may be arranged in a meandering or zigzag pattern around the curved surface of the item of sports equipment.

In one embodiment the electric conductor of the at least one deformable electromagnetic coil structure may be meandered lateral to the circumferential direction along the curved surface in order to obtain a transversal meandering scheme of the coil. Thereby, the transversal direction is to be understood as a direction extending lateral from a main extending direction of a turn of the coil, wherein the main extending direction may be understood as the circumferential direction. That is to say, the transversal direction may be understood as a tangential direction embracing a right angle with the circumferential direction.

In an alternative embodiment the electric conductor of the at least one deformable electromagnetic coil structure may be meandered radially to the circumferential direction along the curved or spherical surface in order to obtain a longitudinal meandering structure. That is to say, in the longitudinal meandering structure the displacement of the electric conductor is in radial direction. Whereas the transversal meandering scheme leads to a rather radially flat coil structure, the longitudinal meandering scheme leads to a coil structure which has a non-negligible radial extension as the meander structure is rotated essentially by 90° compared to the transversal meandering scheme.

In some embodiments it may be beneficial to place or embed the at least one deformable electromagnetic coil structure into an elastic and/or flexible carrier material for better supporting the meandered shape of the coil structure in the playing equipment. Such a construction, which helps to protect a meandered coil from being expanded e.g. by normal air pressure of the sports object, may be placed between an inner bladder and an outer cover of the sports object. Thereby the elastic and/or flexible embedment material, which may be rubber or a similar material, is preferably be stiff enough to keep its form or geometry under normal air pressure of the air inflated ball, but which is also flexible enough to transfer ball compressions caused by hitting the ball or shooting the ball against a goal frame, for example.

According to an alternative embodiment of the present invention an electric conductor of the at least one deformable electromagnetic coil structure may be formed onto an elastically deformable and/or flexible substrate. For example, an aforementioned meandering or zigzag coil structure may be placed onto or integrated into an elastically deformable and/or flexible substrate, as, for example, a stretchable rubber band or a stretchable elastic textile band. In the latter case the electric conductors of the coil structure may be woven into the flexible/elastic textile band, for example.

In other embodiments of the present invention the elongation reserve of the electromagnetic coil structure may also be accomplished by employing elastic electric conductors, such that the elastic or stretchable conductors themselves may act similar to rubber bands placed around the curved or spherical surface within the item of sports equipment. In this case it is possible to arrange the electric conductors around the curved or spherical surface without the aforementioned meandering or zigzag coil structure. For example, such elastic conductors may be based on silver nanowire conductors or carbon nanotubes to get stretchable electromagnetic coils for the electromagnetic coil structure. Additionally, such elastic conductors may be placed on a stretchable substrate for better support and guidance properties of the flexible coils.

As has been explained before, the item of sports equipment may be an inflatable ball having a ball bladder and a ball cover or hull, wherein the at least one deformable electromagnetic coil structure may be arranged in between the ball bladder and the ball cover in some embodiments. In other embodiments, the at least one deformable electromagnetic coil structure may also be arranged within the ball bladder or underneath the surface of the ball bladder. It is even possible to arrange the at least one deformable electromagnetic coil structure on the outer surface of the ball cover in some embodiments.

Optionally the item of sports equipment may comprise means for fixing a position of the at least one deformable electromagnetic coil structure on the curved surface underneath a cover of the item of sports equipment. Thereby the means for fixing may be realized by using seams/threads of a ball cover or dedicated fixation straps arranged around the curved surface in regular distances. The fixation straps may be adhesive according to some embodiments.

In some embodiments it may be beneficial to integrate more electrical components together with the at least one coil in the item of sports equipment. For example, capacitive or resistive components may be integrated together with the coil structure, for example, for implementing one or more resonant circuits in the item of sports equipment. That is to say, in some embodiments the elastically deformable item of sports equipment may further comprise at least one capacitive element coupled to the at least one deformable electromagnetic coil structure to form a resonant circuit for a predetermined frequency or frequency range. For example, the frequency range may be in the sub-megahertz region, i.e., 10 kHz to 150 kHz. This may be particularly interesting for backscatter coupling concepts, wherein antennas installed at the goal may be inductively coupled with one or more coils in the ball via backscattering. Thereby backscattering (inductive coupling) uses the electromagnetic power transmitted by a transmitter to energize the electronics in the ball. Essentially the ball may reflect back some of the transmitted power, but change some of the properties, and in this way also may send back information to the transmitter. In some embodiments the at least one capacitive element may be integrated into a cover of the item of sports equipment or into a cover patch thereof. This may allow for an efficient manufacturing process and for good resonant properties.

According to a further aspect of the present invention it is provided a method for manufacturing an elastically deformable item of sports equipment, in particular an air inflatable ball, comprising a step of arranging at least one deformable electromagnetic coil structure around a curved surface within the item of sports equipment, such that the at least one deformable electromagnetic coil structure has an elongation reserve corresponding to a maximum elastic deformation of the item of sports equipment.

Hence, embodiments of the present invention suggest solutions to the problem of how the at least one coil has to be designed and how it can be integrated into the ball to withstand the mechanical deformation of the ball when hit from a player or shot against the goal frame.

BRIEF DESCRIPTION OF THE FIGURES

Some embodiments of apparatuses and/or methods will be described in the following by way of example only, and with reference to the accompanying figures, in which FIG. 1 schematically illustrates a ball having integrated a deformable electromagnetic coil structure with a circumference which is larger than a circumference of the ball.

DESCRIPTION OF EMBODIMENTS

Various example embodiments will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the invention. Like numbers refer to like or similar elements through-out the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Figure 1:
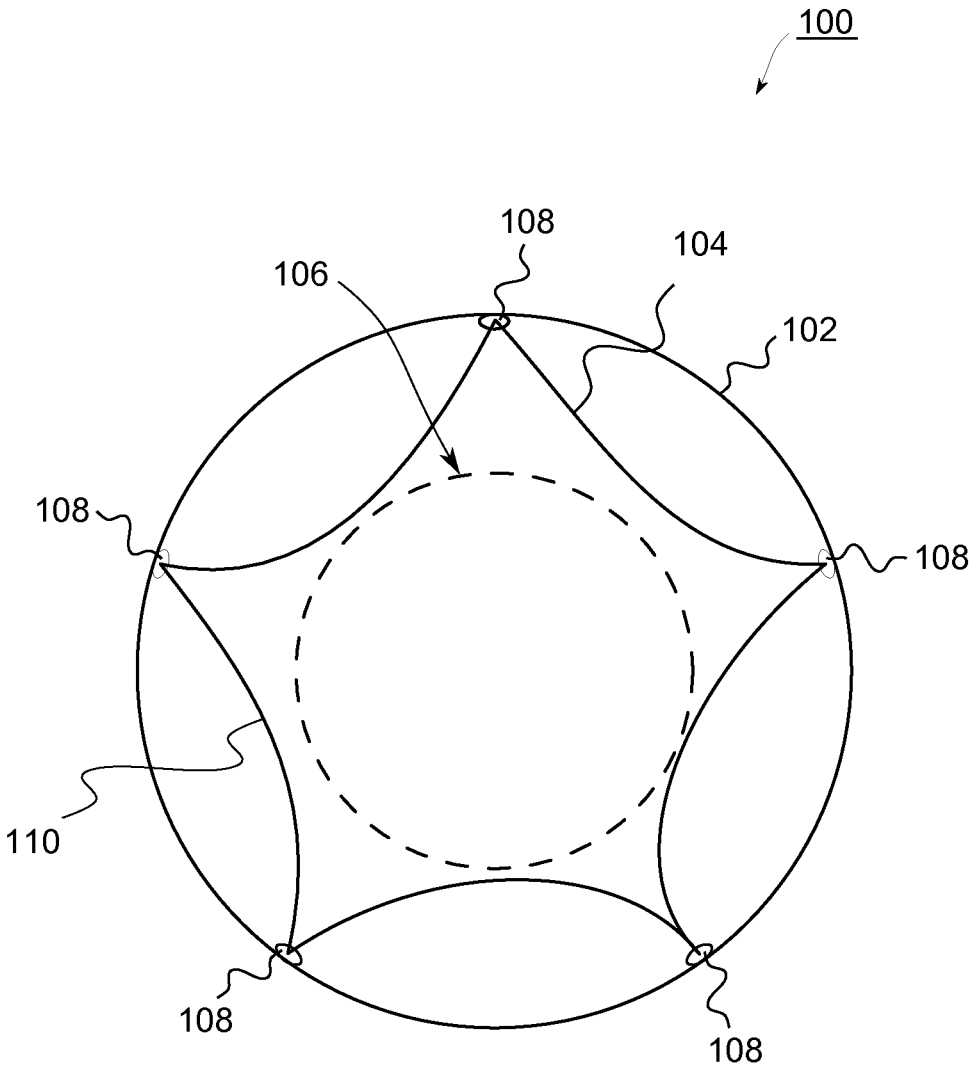

FIG. 1 schematically shows an item of sports equipment in form of a ball 100, according to an embodiment of the present invention.

The ball 100, for example a soccer ball, may be an air inflatable ball. This means that it is elastically deformable when hit by a player or by an obstacle. Underneath an outer ball cover 102 the ball 100 comprises a deformable electromagnetic coil structure 104 which is arranged around a curved surface 106 within the ball 100. As can be seen, the electromagnetic coil structure 104 has a circumferential extension which is longer or larger than the circumference of the ball 100 or its outer cover 102. Due to the larger circumferential extension of the coil structure 104 it has an elongation reserve for compensating elastic deformations (e.g. compressions and/or expansions) of the ball 100.

In the embodiment shown in FIG. 1 the electromagnetic coil structure 104 is fixed to the ball cover 102 by regularly spaced fixation elements 108, which may be seams of the ball cover 102 or some fixation straps arranged around the curved surface 106 in regular distances. The curved surface 106 may be, in an undeformed condition of the ball 100, a spherical surface having a certain circumference, wherein a length of at least one turn of the coil structure 104 is larger than the circumference of the curved surface 106 or the ball 100. As will become apparent the curved surface 106 may, for example, be a surface of an inner ball bladder or an (inner) surface of the ball cover 102.

In some embodiments a section 110 of the coil structure 104 in between two adjacent fixation elements 108 may be located within the ball 100 relatively loosely or unstructured. In other word, the conductor section 110 may extend unguided in between adjacent fixation elements 108. However, as it will become apparent in the following, it may be preferable to provide or foresee a guiding structure for the turns of the coil structure 104.

FIG. 1 only illustrates a side view of one coil. However, the coil structure 104 may comprise at least three deformable electromagnetic coils preferably arranged mutually perpendicular to each other around the curved surface 106 to form at least three loop antennas in the ball 106. The resulting loop antennas may then interact with an electromagnetis field based goal detection system for detecting whether the ball 100 has crossed a goal line or not, for example.

Although the embodiment of FIG. 1 is well conformant to the principles of the present invention, more preferable embodiments with respect to goal detection accuracy qualities will be explained in the following.

Figure 2A:
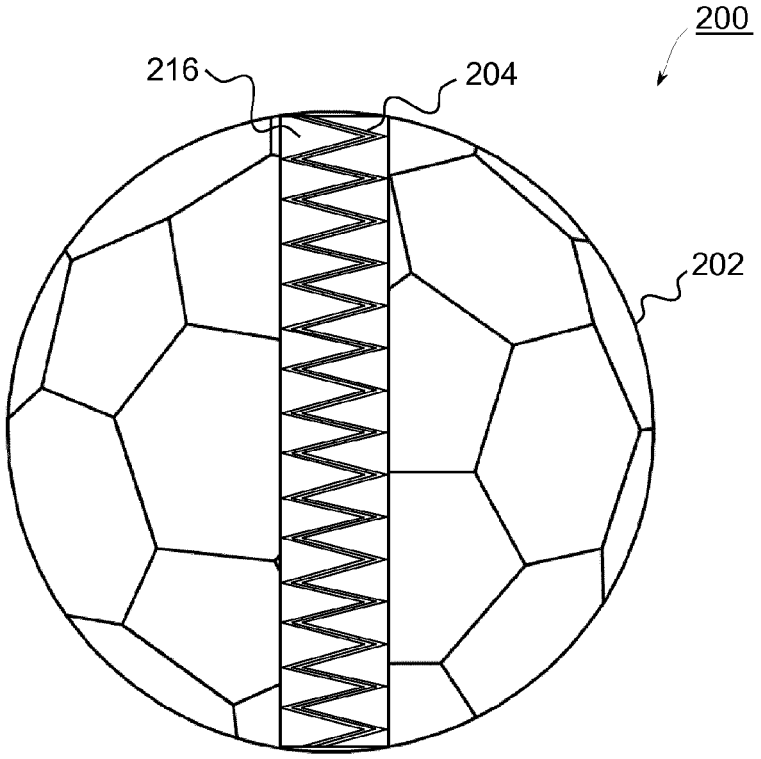
FIG. 2*a* schematically illustrates a ball having integrated a deformable electromagnetic coil structure with transversally meandered electrical conductors.

FIG. 2*a* shows a schematic top view of further embodiment of a ball 200 having an outer ball cover 202 and comprising, underneath the ball cover 202, at least one deformable electromagnetic coil structure 204 which is arranged around a curved surface, e.g. a surface of a ball bladder, within the ball 200. In the embodiment of FIG. 2*a* the deformable electromagnetic coil structure 204 also has an elongation reserve corresponding to a maximum possible mechanical deformation of the air inflatable ball 200. Here, the elongation reserve in circumferential direction is realized by providing electric conductors of the deformable electromagnetic coil structure 204 being arranged in a meandering or zigzag pattern around the curved surface. Due to the meandered winding structure of the electromagnetic coil structure 204, which exemplarily comprises three parallel meandered windings according to FIG. 2*a*, the extension of the coil structure 204 in circumferential direction is larger than that of the ball 200. To be able to follow or compensate any elastic mechanical deformations of the ball up to a maximum extend, the meandered coil structure 204 may be provided on or placed onto an elastically deformable and/or flexible substrate 216. Thereby the elastic or stretchable substrate 216 may be a flexible and elastic PCB, a stretchable rubber-like band or a stretchable elastic textile band, for example, carrying the electric conductors of the coil structure 204. Meandering the coil structure 104 lateral to the circumferential direction, e.g. along the surface of an inner ball bladder (transversal meandering), provides a relatively broad but flat coil construction which can easily be integrated between the ball cover 202 and the inner bladder or any other layer in between.

Figure 2B:
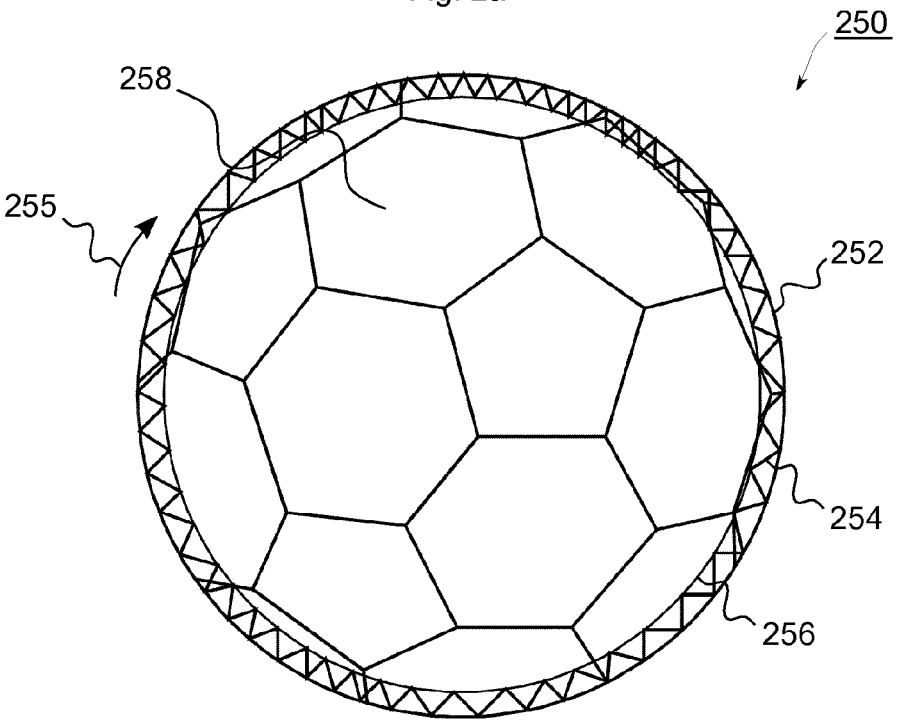
FIG. 2*b* schematically illustrates a ball having integrated a deformable electromagnetic coil structure with longitudinally meandered electrical conductors.

FIG. 2*b* schematically depicts a side view of another exemplary embodiment of the present invention.

A ball 250 having an outer ball cover layer 252 comprises a deformable electromagnetic coil structure 254 having one or more electric conductors being meandered radially to the circumferential direction 255 along or around a spherical surface of the ball (e.g. surface of ball bladder) to obtain a longitudinal meandering structure. Meandering of the at least one coil 254 radially along the circumference of the ball 250 (longitudinal meandering) results in a thicker coil construction compared to the broad but flat coil construction of FIG. 2*a*. However, the coil construction of FIG. 2*b* should preferably be protected from getting radially compressed by the normal inner ball pressure when it is put between the ball cover 252 and the ball bladder 256 or any other layer in between.

In an alternative embodiment the meandering of the electric conductors of the coil structures 204, 254 could also be realized in both directions, i.e., transversal and longitudinal. The resulting coil structure would then be similar to a circumferential spiral.

In some embodiments it may be advantageous to protect a radially meandered coil structure 254 from being expanded or compressed by the normal air pressure of the ball 250. In one embodiment a protection mechanism could be to put the electromagnetic coil structure 254 inside the ball bladder 256. In such an embodiment the coil structure 254 is only exposed to the inner air pressure of the ball 250 and may not be compressed due to pressure differences between the inside and the outside of the ball. The coil structure 254 may then be fixed on a few, at least three, points around the circumference of the bladder 256 in order to stay in a predefined position within the ball 250.

Additionally or alternatively the coil structure 254 may be molded into an elastic and/or flexible embedment material for supporting the longitudinally or radially meandered shape of the coil structure 254. Thereby the longitudinally or radially meandered coil structure 254 may be embedded into rubber or a similar embedment material, which is, on the one hand, stiff enough to keep its radial thickness under normal air pressure conditions of the ball 250 but which is, on the other hand, also flexible enough to absorb or transfer elastic ball compressions or expansions caused by hitting the ball or shooting the ball against on obstacle. A resulting molded coil construction may be placed between the ball bladder 256 and the ball cover 252 according to some embodiments.

When putting the longitudinally or radially meandered coil structure 254 between the ball cover 252 and the ball bladder 256 also additional individual supporting pads could radially support the coil 254 and prevent its radial compression in some embodiments. The supporting pads may be made from rubber or a similar material and should preferably be stiff enough to not being radially compressed by normal air pressure of the ball 250. However, they should be able to absorb the additional elongation of the coil structure due to elastic ball deformations. An embodiment with a longitudinally or radially meandered coil structure supported radial support pads is schematically illustrated by FIG. 3.

Figure 3:
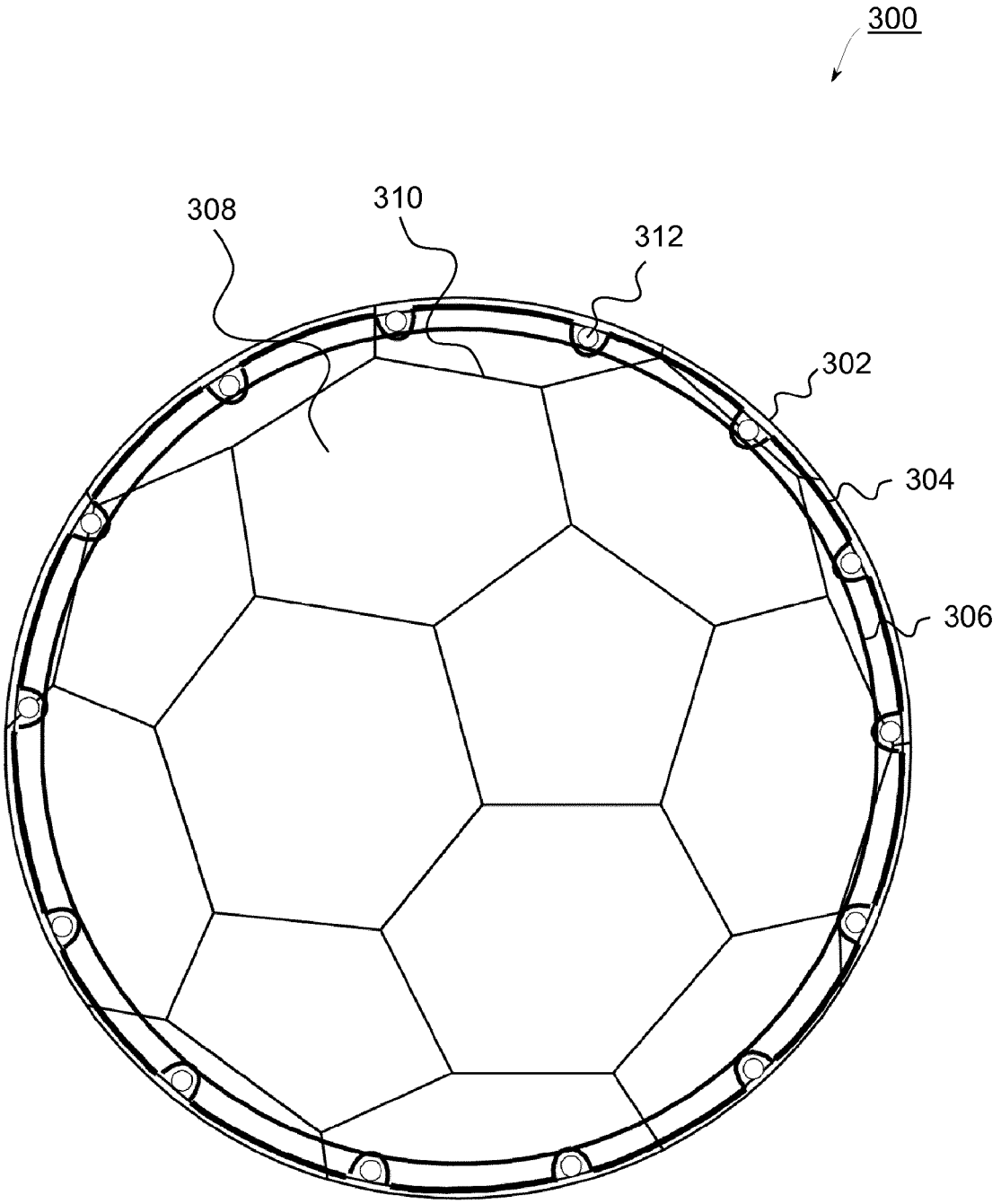
FIG. 3 shows a ball comprising supporting pads between a coil structure and an outer ball cover.

FIG. 3 shows a ball 300 having a ball cover 302 made of a plurality of cover patches 308. The cover patches 308 may be kept together by threads or seams 310. Between the outer ball cover 302 and an inner ball bladder it is provided a longitudinally or radially meandered coil structure 304. The ball comprises a plurality of radial support pads 312 for preventing radial compression of the coil structure 304. For that purpose a radial extension of the regularly spaced support pads 312 may be at least as large as a radial extension of the radially meandered coil structure 304. In that way the support pads 312 may act a distance keeping elements between the ball bladder 306 and the ball cover 302.

For longitudinally or radially meandered coil structures the windings of the coil(s) and/or the substrate or carrier material in which the coil windings are embedded does need not to be flexible with respect to its radial thickness. Moreover, the windings and the carrier material may be quite stiff such that they can transfer an elongation force due to a mechanical deformation to the support pads 312 and compress them. In one embodiment of the invention the fixation elements or supports could be seams 310 of the ball's cover patches 308. The cover patches' 310 seams are stiff enough to stay in their position during normal ball pressure conditions but can be compressed by additional mechanical forces due to ball compression.

Optionally the ball 300 may also comprises means for fixing a position of the at least one deformable electromagnetic coil structure 304 on the curved surface underneath the ball cover 302. Thereby the means for fixing may comprise the seams 310 of the cover 302 or other fixation elements arranged on the circumference of the curved surface of the ball bladder 306 or the cover 302 in regular distances, similar to the elements 108 shown in FIG. 1.

Figure 4:
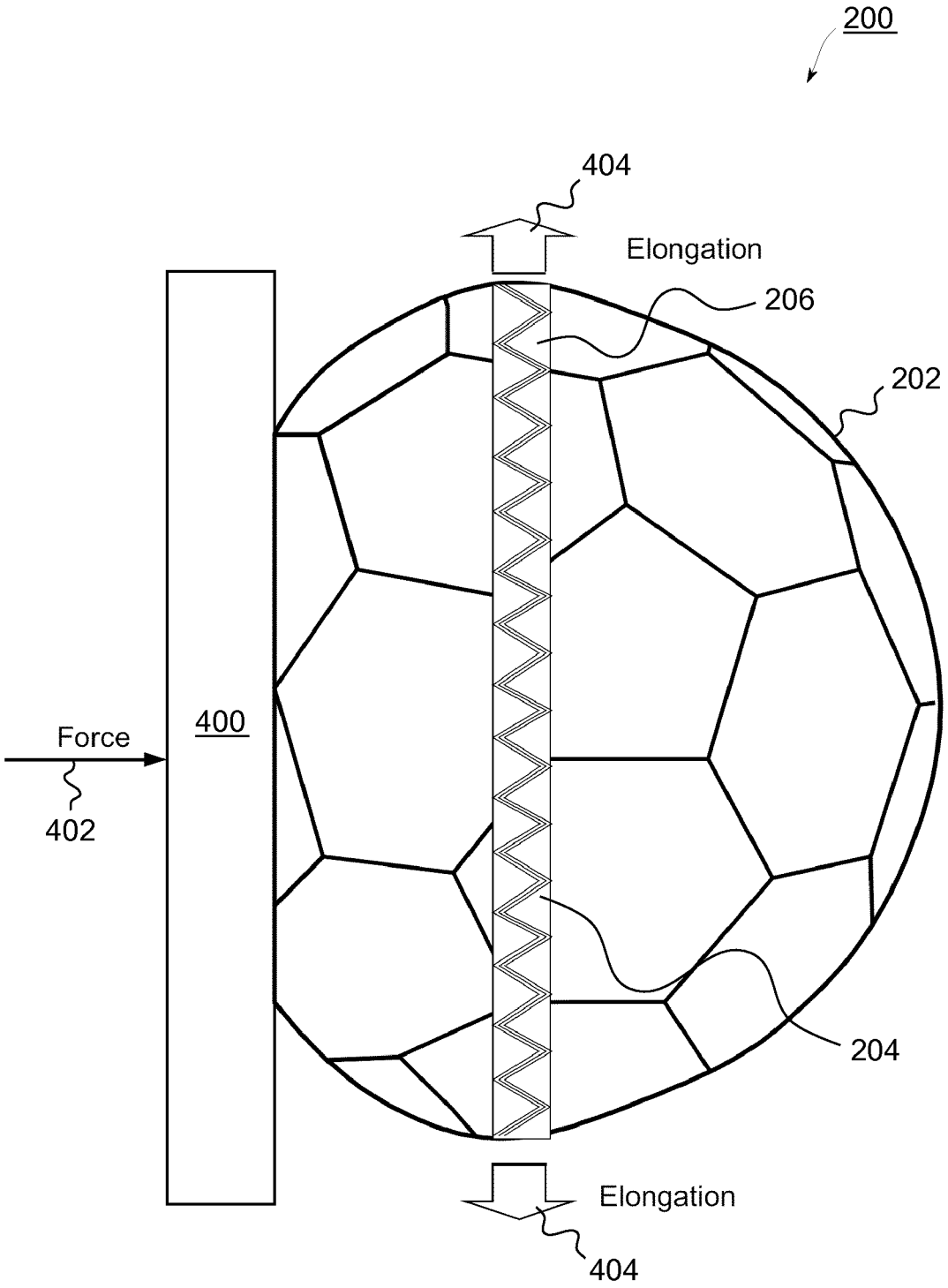
FIG. 4 illustrates an elongation of the circumference of a ball upon mechanical deformation.

FIG. 4 shows an example where ball 200 hits a wall or a flat surface, i.e., an obstacle 400. When the ball 200 hits the flat surface 400, the ball 200 is elastically deformed or compressed in the direction of an acting force 402. The mechanical compression cannot be completely compensated and the ball 200 expands in other directions 404 orthogonal to the direction of acting force 402. If the coil structure 204, i.e. its opening surface, is parallel to the impact surface of obstacle 400, as shown in FIG. 4, the expanding force 402 affects the coil structure 204 and elongates it in vertical direction 404. Due to the coil structure's elongation reserve the coil structure 204 may participate in said expansion without any damages.

Besides its stretching or deformation capabilities the electromagnetic coil structure may be fixed quite precisely inside the ball. In particular, when three coils are used which have to be essentially perpendicular to each other, an appropriate fixation of the coil structure within the ball may be advantageous. Thereby the coil fixation should fulfill the following requirements:

- The coil structure or the individual coils thereof should be kept as close as possible to the outer shape of the ball (i.e., close to inner cover or bladder wall) for a maximum circumference of the coil structure;
- A coil should also not be able to essentially move in transversal direction;
- The orthogonality of the three coils of the coil structure should be sustained; and
- A coil should be free to move in direction of its windings, in i.e. longitudinal or circumferential direction.

To fulfill these requirements correspondingly designed fixation flaps can be used, which may be attached to the cover or bladder of the ball. A coil may be fed through the flaps for free movement in longitudinal or circumferential direction. Instead of several flaps a circumferential tube for a coil may also be used.

Figure 5:
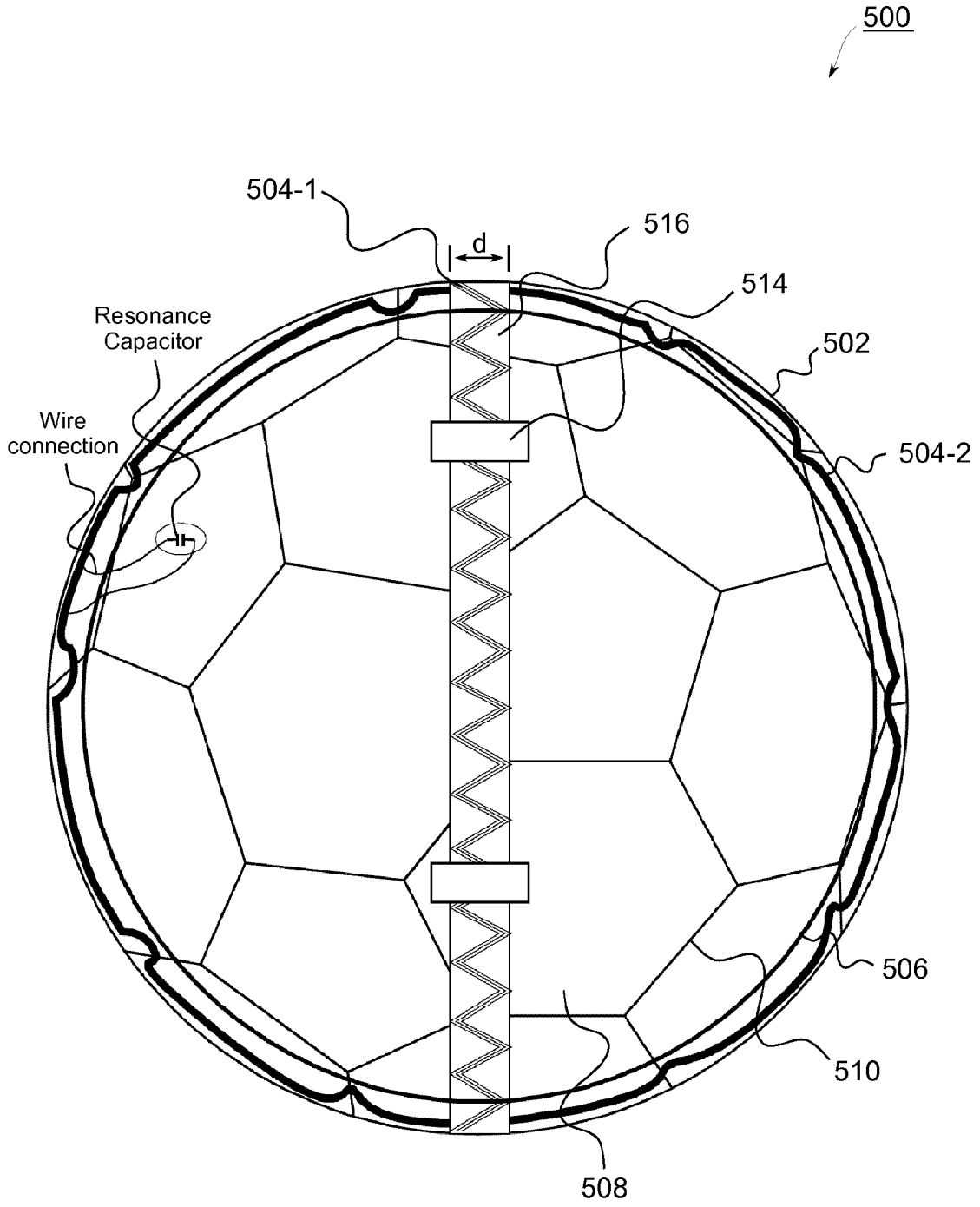
FIG. 5 illustrates a ball with coil loops, fixation straps and a resonance capacitor integrated into a cover patch.

FIG. 5 shows an embodiment of a ball 500 housing a deformable electromagnetic coil structure 504 which comprises a first coil 504-1 and a second coil 504-2. The two coils 504-1 and 504-2 are essentially orthogonal to each other. Thereby an "orthogonally arranging" of coils may be understood as arranging the two or more coils such that linearly extending conductor paths of two different coils are essentially perpendicular to each other at their points of intersection. Another definition could be that the surface normals of opening surfaces of the coils are essentially perpendicular to each other. In order to have defined and fixed intersection points between to different coils special fixation elements for or at the intersection points may be provided, such as lugs, feed-throughs or the like. In FIG. 5 a third coil, which is arranged orthogonally to the other two coils 504-1 and 504-2, respectively, may be present as well.

As can be seen from FIG. 5, the electromagnetic coil structure 504 or the individual coils 504-1, 504-2 thereof may be fixed absolutely and relatively in their positions by one or more fixation straps 514, respectively. Thereby the fixation straps 514 may fix the coils 504-1, 504-2 to the inner ball bladder 506 and/or to the inner surface of the ball cover 502. The fixation straps 514 are thereby configured to prevent the displacement of the coils 504-1, 504-2 in transversal direction relative to the curved surface of the bladder 506 or the cover 502. Also, the fixation straps 514 are configured to allow a free movement of the coils 504-1, 504-2 in their respective circumferential or longitudinal direction along the curved surface of the bladder 506 or the cover 502. Furthermore, the mutual orthogonality of the coils 504-1 and 504-2 may essentially be kept due to the use of the fixation straps 514.

In a preferred embodiment of the present invention the fixation straps 514 may be used to fix the coils 504-1, 504-2 to or onto cover patches 508 when mounted between the cover 502 and the bladder 506. In some embodiments of the straps 514 may have the same width d as the elastic coil substrate or band 516, such that no or only little transversal movement of the coils 504-1, 504-2 is possible. Note, that one or more tuning capacitors connected to the coil structure 504 may be foreseen.

Figure 6A:
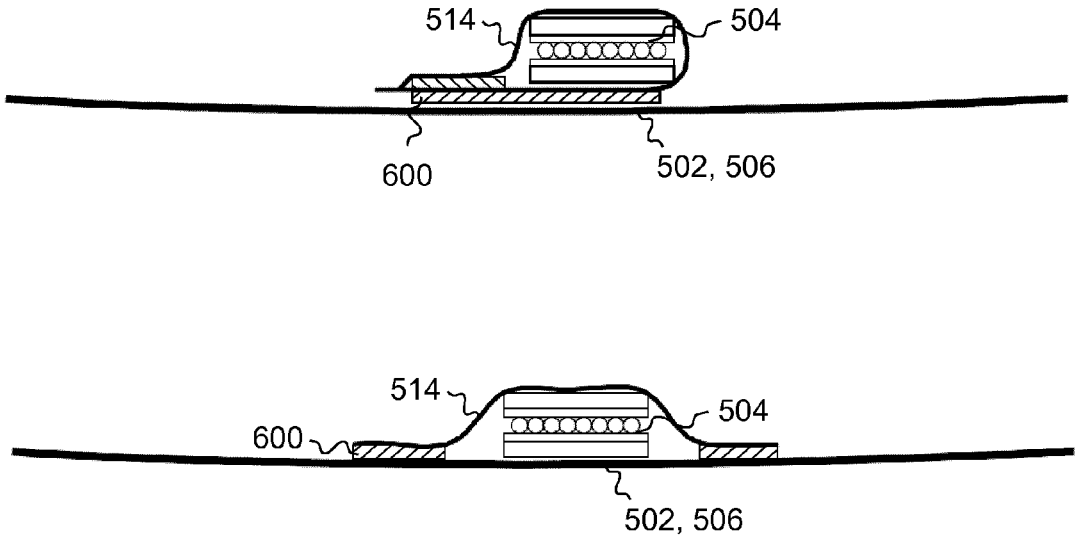
FIG. 6*a* schematically shows some coil fixation examples.
Figure 6B:
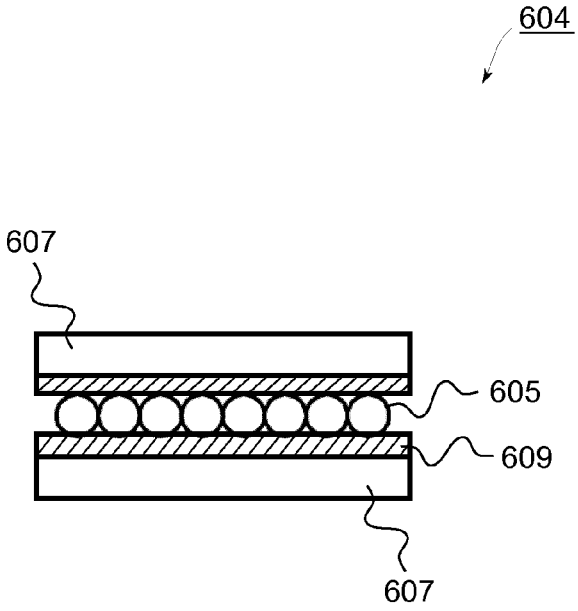
FIG. 6*b* illustrates a cross section of a coil composition according to an embodiment.

FIGS. 6*a* and 6*b* show two embodiments related to the fixation of the electromagnetic coil 504 to the ball cover 502 and/or the ball bladder 506 using fixation straps 514. Thereby the fixation straps 514 may be fixed to the ball cover 502 and/or the ball bladder 506 by means of an adhesive material 600. That is to say, the fixation straps 514 may be glued to the surface of a ball cover patch 508 or the ball bladder 506. In the embodiment depicted in the upper FIG. 6*a* the coil structure 504 is completely surrounded by the fixation strap 514. That is to say, the fixation strap 514 forms a loop around the coil structure 504, wherein the whole loop structure of the fixation strap 514 is adhered to the ball cover 502 or ball bladder 506. In the embodiment of lower FIG. 6*a* the fixation strap 514 acts as a one-side cover for covering the coil structure 504. In this embodiment the electromagnetic coil structure 504 is placed in between the fixation strap 514 and the surface of the ball cover 502 or the ball bladder 506. Thereby the fixation strap 514 may be adhered to the ball cover 502 or ball bladder 506 on both sides (left and right) of the coil structure 504.

In FIG. 6*b* a cross section of one embodiment of a coil structure 604 is shown schematically. The coil structure 604 comprises conductive windings 605 made of electrically conductive material like copper, silver or aluminium. The coil structure 604 also comprises bottom and/or top cover substrates 607 which may be fixed or attached to the windings 605 by means of an adhesive layer 609, respectively. That is to say, according to some embodiments the windings 605 may be laminated between the bottom and top cover substrates 607.

In some cases it might be necessary to tune the electromagnetic coil structure to a certain resonance frequency of a goal detection system, for example, to a frequency of 125 kHz. For that purpose a stray capacitance of the coil structure can be sufficient, however, an additional dedicated capacitive element may also be necessary. Hence, according to some embodiments the elastically deformable item of sports equipment, e.g. a ball, may further comprise at least one capacitive element coupled to the at least one deformable electromagnetic coil structure to form a resonant circuit for a predetermined frequency, e.g. in the range of 10 kHz to 150 kHz. As capacitive elements or capacitors are often made of ceramic or similar material, they have to be better protected than the inductive coil structure. For that purpose, some embodiments of the present invention suggest to integrate at least one capacitive element into a patch of a ball cover.

Figure 7:
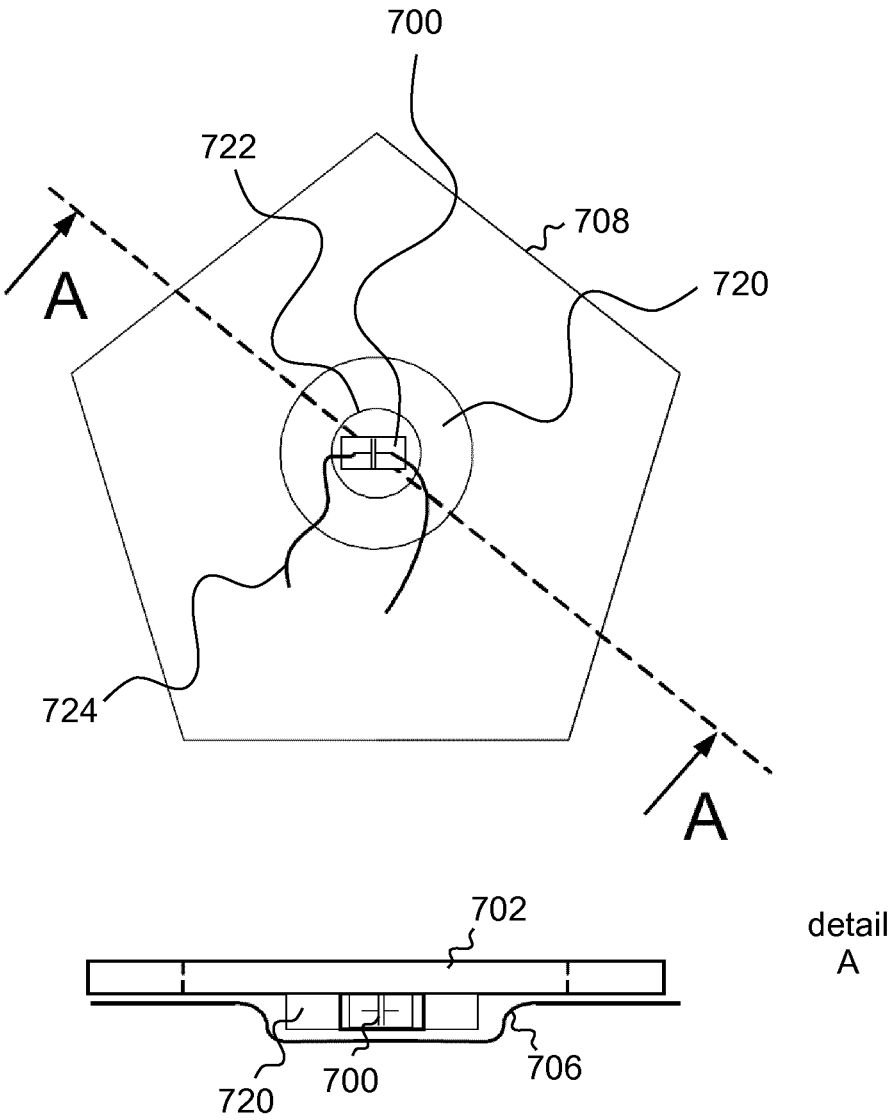
FIG. 7 illustrates an example for fixing a tuning capacitor at a ball cover.
Figure 8:
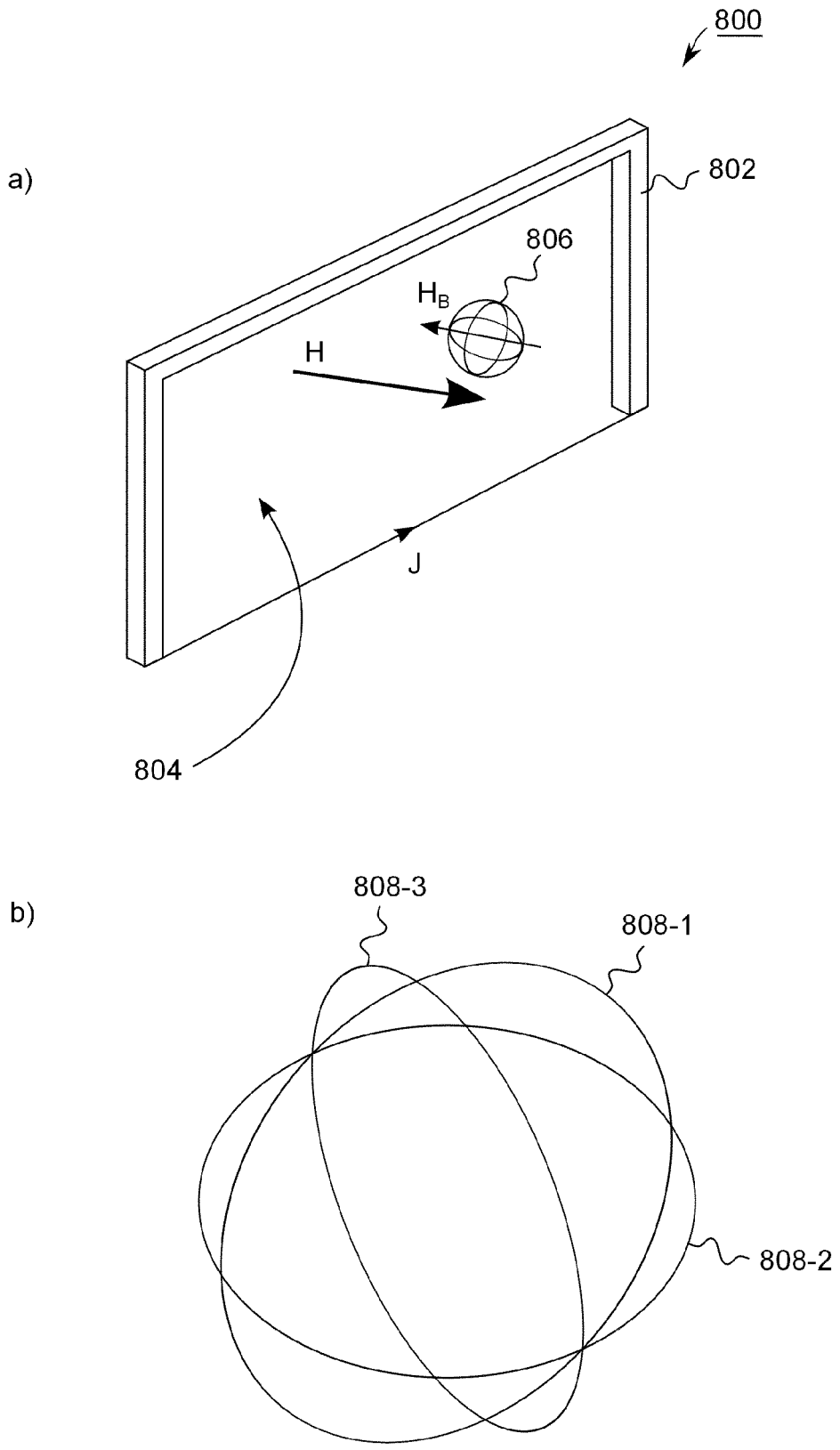
FIG. 8*a* illustrates a principle of a goal detection system.
FIG. 8*b* illustrates three coils placed orthogonally underneath a ball surface.

FIG. 7 shows an embodiment for the fixation of a tuning capacitor 700. A case or protection ring 720, which may be made of flexible material like rubber, foam, or a material similar to a cover patch material, may be attached to an inner surface of a ball cover patch 708. The radial extension of the case ring 720 may be high enough and the case ring 720 may have a hole 722 with a diameter big enough such that at least one passive capacitor component 700 for resonance tuning of the coil structure may be placed within the hole 722. The capacitor 700 may be connected to the coil structure and/or other electronic components via connection wires 724 which may be soldered to corresponding connectors of the capacitor 700. After having deposited the capacitor 700 in the hole 722 the latter may be filled with glue or another molding material to fix the capacitor 700 and the connection wires 724 within the case ring 720. The lower cross-sectional view of FIG. 7 illustrates how the case ring 720 housing the capacitor 720 may fit between the ball cover 702 and the ball bladder 706. If the deformable electromagnetic coil structure comprises more than one electromagnetic coil, each of the plurality of electromagnetic coils may be tuned separately to a predefined resonance frequency or frequency range by at least one capacitor, respectively.

The description and drawings merely illustrate the principles of the invention. It will thus be appreciated that those skilled in the art will be able to devise various arrangements that, although not explicitly described or shown herein, embody the principles of the invention and are included within its spirit and scope. Although embodiments have been illustrated with respect to goal-detection systems, alternative embodiments may also related to anti-theft devices (e.g. the insertion of flexible coils into or onto goods), further sports, like e.g. ice hockey. Also, embodiments may be useful for surveying safety areas, for example by integrating flexible and flat coils in shoes or the like.

Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Furthermore, the following claims are hereby incorporated into the Detailed Description, where each claim may stand on its own as a separate embodiment. While each claim may stand on its own as a separate embodiment, it is to be noted that—although a dependent claim may refer in the claims to a specific combination with one or more other claims—other embodiments may also include a combination of the dependent claim with the subject matter of each other dependent claim. Such combinations are proposed herein unless it is stated that a specific combination is not intended. Furthermore, it is intended to include also features of a claim to any other independent claim even if this claim is not directly made dependent to the independent claim.

It is further to be noted that methods disclosed in the specification or in the claims may be implemented by a device having means for performing each of the respective steps of these methods.

Further, it is to be understood that the disclosure of multiple steps or functions disclosed in the specification or claims may not be construed as to be within the specific order. Therefore, the disclosure of multiple steps or functions will not limit these to a particular order unless such steps or functions are not interchangeable for technical reasons. Furthermore, in some embodiments a single step may include or may be broken into multiple sub steps. Such sub steps may be included and part of the disclosure of this single step unless explicitly excluded.

The invention claimed is:

1. An elastically deformable item of sports equipment, comprising:

at least one deformable loop antenna arranged around a curved surface within the elastically deformable item of sports equipment, wherein the at least one deformable loop antenna has an elongation reserve corresponding to a maximum elastic deformation of the elastically deformable item of sports equipment, wherein the elastically deformable item of sports equipment is a ball having a ball bladder and a ball cover, and wherein the at least one deformable loop antenna is arranged between the ball bladder and the ball cover, wherein the electric conductor of the at least one deformable loop antenna is formed on a flexible printed circuit board.

2. The elastically deformable item of sports equipment according to claim 1, wherein a length of one turn of the at least one deformable loop antenna is larger than a circumference of the elastically deformable item of sports equipment.

3. The elastically deformable item of sports equipment according to claim 1, wherein an electric conductor of the at least one deformable loop antenna is arranged in a meandering or zigzag pattern around the curved surface.

4. The elastically deformable item of sports equipment according to claim 3, wherein the electric conductor of the at least one deformable loop antenna is meandered lateral to a circumferential direction along the curved surface to obtain a transversal meandering.

5. The elastically deformable item of sports equipment according to claim 3, wherein the electric conductor of the at least one deformable loop antenna is meandered radial to a circumferential direction along the curved surface to obtain a longitudinal meandering.

6. The elastically deformable item of sports equipment according to claim 3, wherein the electric conductor of the at least one deformable loop antenna is molded into an elastic or flexible carrier material for supporting the meandered shape of the at least one deformable loop antenna.

7. The elastically deformable item of sports equipment according to claim 1, wherein the at least one deformable loop antenna comprises at least one turn of an elastic electric conductor.

8. The elastically deformable item of sports equipment according to claim 1, wherein the elastically deformable item of sports equipment comprises means for fixing a position of the at least one deformable loop antenna on the curved surface underneath the ball cover.

9. The elastically deformable item of sports equipment according to claim 8, wherein the means for fixing comprises seams of the ball cover or fixation straps arranged around the curved surface in regular distances.

10. The elastically deformable item of sports equipment according to claim 1, further comprising at least one capacitive element coupled to the at least one deformable loop antenna to form a resonant circuit for a predetermined frequency in the range of 10 kHz to 150 kHz.

11. The elastically deformable item of sports equipment according to claim 10, wherein the at least one capacitive element is integrated into the ball cover or into a patch of the elastically deformable item of sports equipment.

12. The elastically deformable item of sports equipment according to claim 1, further comprising at least three deformable electromagnetic coils arranged mutually perpendicular to each other around the curved surface to form at least three deformable loop antennas in the elastically deformable item of sports equipment.

13. The elastically deformable item of sports equipment according to claim 12, wherein each of the at least three deformable electromagnetic coils is tuned separately to a resonance frequency by at least one capacitor, respectively.

14. The elastically deformable item of sports equipment according to claim 1, wherein the at least one deformable loop antenna is elastically deformable.

15. An elastically deformable item of sports equipment, comprising:

at least one deformable loop antenna arranged around a curved surface within the elastically deformable item of sports equipment, wherein the at least one deformable loop antenna has an elongation reserve corresponding to a maximum elastic deformation of the elastically deformable item of sports equipment, wherein the elastically deformable item of sports equipment is a ball having a ball bladder and a ball cover, and wherein the at least one deformable loop antenna is arranged between the ball bladder and the ball cover, wherein seams of the ball cover or fixation straps arranged around the curved surface in regular distances fix a position of the at least one deformable loop antenna on the curved surface underneath the ball cover.

16. An elastically deformable item of sports equipment, comprising:

at least one deformable loop antenna arranged around a curved surface within the elastically deformable item of sports equipment, wherein the at least one deformable loop antenna has an elongation reserve corresponding to a maximum elastic deformation of the elastically deformable item of sports equipment, wherein the elastically deformable item of sports equipment is a ball having a ball bladder and a ball cover, and wherein the at least one deformable loop antenna is arranged between the ball bladder and the ball cover, wherein at least three deformable electromagnetic coils are arranged mutually perpendicular to each other around the curved surface to form at least three deformable loop antennas in the elastically deformable item of sports equipment.

17. The elastically deformable item of sports equipment according to claim 16, wherein each of the at least three deformable electromagnetic coils is tuned separately to a resonance frequency by at least one capacitor, respectively.

* * * * *